US006769332B2

(12) United States Patent
Muro

(10) Patent No.: US 6,769,332 B2
(45) Date of Patent: Aug. 3, 2004

(54) SUCCESSIVE SCREW DRIVING ATTACHMENT

(75) Inventor: Giichiro Muro, Tochigi-ken (JP)

(73) Assignee: Muro Corporation, Tokyo (JP)

( * ) Notice: Subject to any disclaimer, the term of this patent is extended or adjusted under 35 U.S.C. 154(b) by 0 days.

(21) Appl. No.: 09/538,473

(22) Filed: Mar. 30, 2000

(65) Prior Publication Data

US 2001/0035078 A1 Nov. 1, 2001

(30) Foreign Application Priority Data

Mar. 30, 1999 (JP) ..... 11-088164

(51) Int. Cl.[7] ..... B25B 24/06
(52) U.S. Cl. ..... 81/434; 81/57.37
(58) Field of Search ..... 81/434, 57.37; 206/344–347; 411/399

(56) References Cited

U.S. PATENT DOCUMENTS 4,146,071 A * 3/1979 Mueller et al. ..... 81/434
5,101,697 A * 4/1992 Fishback ..... 81/434
5,568,753 A * 10/1996 Habermehl et al. ..... 81/434
5,584,221 A * 12/1996 Petrantoni ..... 81/434
5,855,151 A * 1/1999 Habermehl ..... 81/434
5,927,163 A * 7/1999 Habermehl et al. ..... 81/434
6,164,170 A * 12/2000 Habermehl et al. ..... 81/434

* cited by examiner

*Primary Examiner*—Lee D. Wilson
(74) *Attorney, Agent, or Firm*—Sughrue Mion PLLC

(57) ABSTRACT

A successive screw driving attachment is used by being connected to an electric screwdriver D, wherein a driver unit 2 has a screw feed mechanism 3 that is slidable in the drive direction of a screw S. The screw feed mechanism 3 is provided with a screw feeder 20 comprising a screw feed prong 15 that successively feeds screws S to the driving position of a bit 8, and the screw feeder 20 is structured such that the next screw S is instantly fed to the driving position. An adjustment device is provided to vary the stroke of the drill bit.

4 Claims, 11 Drawing Sheets

(a)

(b)

(a)

(b)

1

SUCCESSIVE SCREW DRIVING ATTACHMENT

BACKGROUND OF THE INVENTION

1. Field of the Invention

The present invention relates to a successive screw driving attachment for successively driving screws in order to fasten sheets or boards made of wood, metal, gypsum, or the like to floors or walls, and more particularly to a successive screw driving attachment with which screws can be smoothly fed to the driving position of a bit.

2. Prior Art

There have been proposals in the past for a successive screw driving attachment that is attached to an electric screwdriver and that successively drives screws in order to fasten sheeting made of wood, metal, gypsum, or the like to floors or walls. As shown in FIG. 12, this type of successive screw driving attachment 101 has a screw feed mechanism 103 attached slidably in the driving direction of a screw S to a driver unit casing 102 that is used by being detachably connected to an electric screwdriver D.

This successive screw driving attachment 101 turns the S (corresponds to a standard screwdriver tool) with a rod-shaped bit 104 that drives the screw S, drives this screw S into a sheet or board, and at the same time gradually retracts the screw feed mechanism 103 within the driver unit casing 102. The driving of the screw S is then concluded at the point when the distal end of this bit 104 is at roughly the same position as the distal end portion 103*a* of the screw feed mechanism 103.

This successive screw driving attachment 101 makes use of a screw rope SR in which numerous screws S are stung onto a plastic rope. This screw rope SR is incrementally played out to the driving position of the bit 104 in interlock with the driving operation in the screw feed mechanism 103. When this successive screw driving attachment 101 is used, the trigger switch on the grip handle of the electric screwdriver D is pulled, the bit 104 is turned by the motor of the electric screwdriver D, the distal end of the bit 104 is engaged with the head of the screw S at the distal end of the screw rope SR loaded in the screw feed mechanism 103, and [the screw S] is driven into the sheeting or other material by the rotation of this bit 104.

Problems which the Invention is Intended to Solve

Because a feed lever 105 for the screws S see-saws back and forth in the conventional screw feed mechanism 103 described above, the operation in which the screws S of the screw rope SR are grabbed by a screw feed prong 106 and fed to the driving position does not itself pose any problems. When the driving of a single screw S is complete, however, the next screw S is fed to the driving position while the screw feed mechanism 103 is still being pushed back to the distal end, so there is a problem in that the head of this next screw S hits the distal end of the bit 104.

With the conventional successive screw driving attachment 101, when the screw rope SR was loaded into the screw feed mechanism 103, the first screw S had to be fed to the driving position by pressing this screw feed mechanism 103 against the sheeting once to effect the reciprocal action of the screw feed prong 106. Also, a multi-step operation had to be carried out when the work of driving the screws S was complete and the screw rope SR was to be taken out of the screw feed mechanism 103 while still partially unused.

Furthermore, the attachment position of the rope R varied with the type of screws S being used. Because the position of the rope guide path of the screw feed mechanism 103 varied according to the length of the screws S, screws S with different attachment positions for the rope R could not be loaded into the same screw feed mechanism 103. Moreover, since a single successive screw driving attachment 101 could only accommodate a narrow range of screw lengths, a dedicated successive screw driving attachment 101 had to be used for short screws, and another dedicated successive screw driving attachment 101 for long screws, meaning that a plurality of successive screw driving attachments 101 were required.

Another problem was that when the conventional successive screw driving attachment 101 was used on a floor, the worker had to operate the successive screw driving attachment 101 while bending over or kneeling, so the worker tended to become fatigued when working for an extended period. In view of this, there has been a need for the proposal of a successive screw driving attachment with which driving work could be performed while the worker was standing.

The present invention was conceived in light of the above problems, and it is an object thereof to provide a successive screw driving attachment with which the screw rope can be smoothly loaded to the driving position by delaying the timing at which the screws are fed to the driving position with a stopper provided to the feed lever of the screw rope, and with which there is no need to fed the first screw of the screw rope up to the driving position, and the screw rope can be removed with one finger.

SUMMARY OF THE INVENTION

In order to achieve the stated object, the successive screw driving attachment pertaining to the present invention is a successive screw driving attachment in which a screw feed mechanism and a distal end screw guide are provided to the front part of a driver unit, and a coupling tube for connecting to an electric screwdriver via a coupling adapter is provided to the rear part of the driver unit, the essence of which is that the driver unit forms a guide tube into which a bit is inserted, an elastic member is mounted for pressing the screw feed mechanism forward so that it is slidable in the longitudinal direction of the guide tube, and there is a drive depth adjustment mechanism that adjusts the depth to which the screw is driven by the bit, the screw feed mechanism is provided with a screw feeder comprising a screw feed prong that sequentially feeds the screws on a screw rope, in which numerous screws are lined up and attached to a rope, to the driving position of the bit in interlock with the longitudinal sliding of the driver unit that accompanies the driving action produced by the bit in the distal end screw guide, the screw feeder is structured such that the screw feed prong instantly feeds the next screw to the driving position when the screw feed mechanism has been pushed back to the distal end, and the distal end screw guide has a rope guide path for the screw rope, and has formed in it a screw feed hole for the reciprocal action of the screw feed prong.

With the above constitution, the successive screw driving attachment can be easily coupled to an electric screwdriver via a coupling adapter. In particular, a single successive screw driving attachment can be coupled to a number of different electric screwdrivers by exchanging the coupling adapter.

In the use of the successive screw driving attachment pertaining to the present invention, the first step is to load the screw rope into the distal end screw guide, which places the screw at the front of the screw rope in the driving position. The motor of the electric screwdriver is rotated, the contact face of the distal end screw guide of the screw feed mechanism is pressed against the sheeting or other material, and the bit is turned so that the screw can be gradually driven into the sheeting or other material. Simultaneously with this driving of the screw, the screw feed mechanism (the distal end screw guide) gradually retracts within the driver unit, the distal end screw guide that is integrated with this screw feed mechanism collides with and stops at a drive depth adjustment mechanism housed in the driver unit, and this disengages a clutch and concludes the driving of the screw.

When the distal end screw guide is removed from the sheeting, the screw feed mechanism is pushed back to its original position at the distal end, the screw feed prong of the screw feeder operates and instantly feeds the next screw on the screw rope to the driving position of the distal end screw guide, and screw driving work can then be performed in the same manner as above. Screws can be driven successively by repeating this operation over and over.

The screw feed mechanism has a feed lever that is formed in an approximate caret shape and is attached rotatably around a fulcrum, the driven portion of this feed lever is engaged with a cam housing formed in the driver unit, and the screw feed prong on the free portion of the feed lever is reciprocally operated. Also, a stopper for keeping the screw rope in a feed standby state is provided to the feed lever, and the stopper is released when the screw feed mechanism has been pushed back to the distal end in the screw driving operation, allowing the screw feed lever to be operated instantaneously This action of the stopper of the feed lever allows the screw feed prong to be kept in the standby state it is in before a screw is fed to the driving position while the screw feed mechanism is being pushed back in the distal end direction upon completion of the driving of one screw and while a screw is being driven by the bit. After this, the next screw will not be fed to the driving position before the screw feed mechanism has been completely pushed back to the distal end, which prevents the head of the screw from hitting the distal end of the bit. Once the screw feed mechanism has been completely pushed back to the distal end, the stopper of the feed lever is released, and the next screw can be instantaneously fed to the driving position.

The screw feed prong is a member formed in the shape of a rod, and is rotatably attached to the free portion of the feed lever so as to be roughly parallel to the feed direction of the screw rope and so that the distal end side thereof projects to the driving position.

Because this screw feed prong has a narrow swing angle, it just needs to be tilted a little for the loading of the screw rope to be completed quickly. Also, the screw rope can be easily removed from the distal end screw guide by pressing the screw feed prong from the outside upon completion of the driving of a screw.

The screw feed mechanism can be structured such that the distal end screw guide can be detachably attached. For instance, screws can be driven into a sheeting material in a constantly stable state by installing a distal end screw guide equipped with a long screw guide tube on the screw feed mechanism when long screws are used, and a distal end screw guide equipped with a short screw guide tube when short screws are used.

A bracket can be attached to the coupling adapter, and an arm having a grip can be detachably attached to this bracket. If an arm having a grip is thus attached to the rear of the coupling adapter, the driving work can be performed by holding the grip of the arm, rather than the grip handle of the electric screwdriver. This makes it possible for the worker to drive screws into a floor while standing upright. Also, screws can be driven into ceilings and other high places without the worker having to stand on a ladder.

DETAILED DESCRIPTION OF THE INVENTION

Embodiments of the successive screw driving attachment pertaining to the present invention will now be described through reference to the figures.

Figure 1:
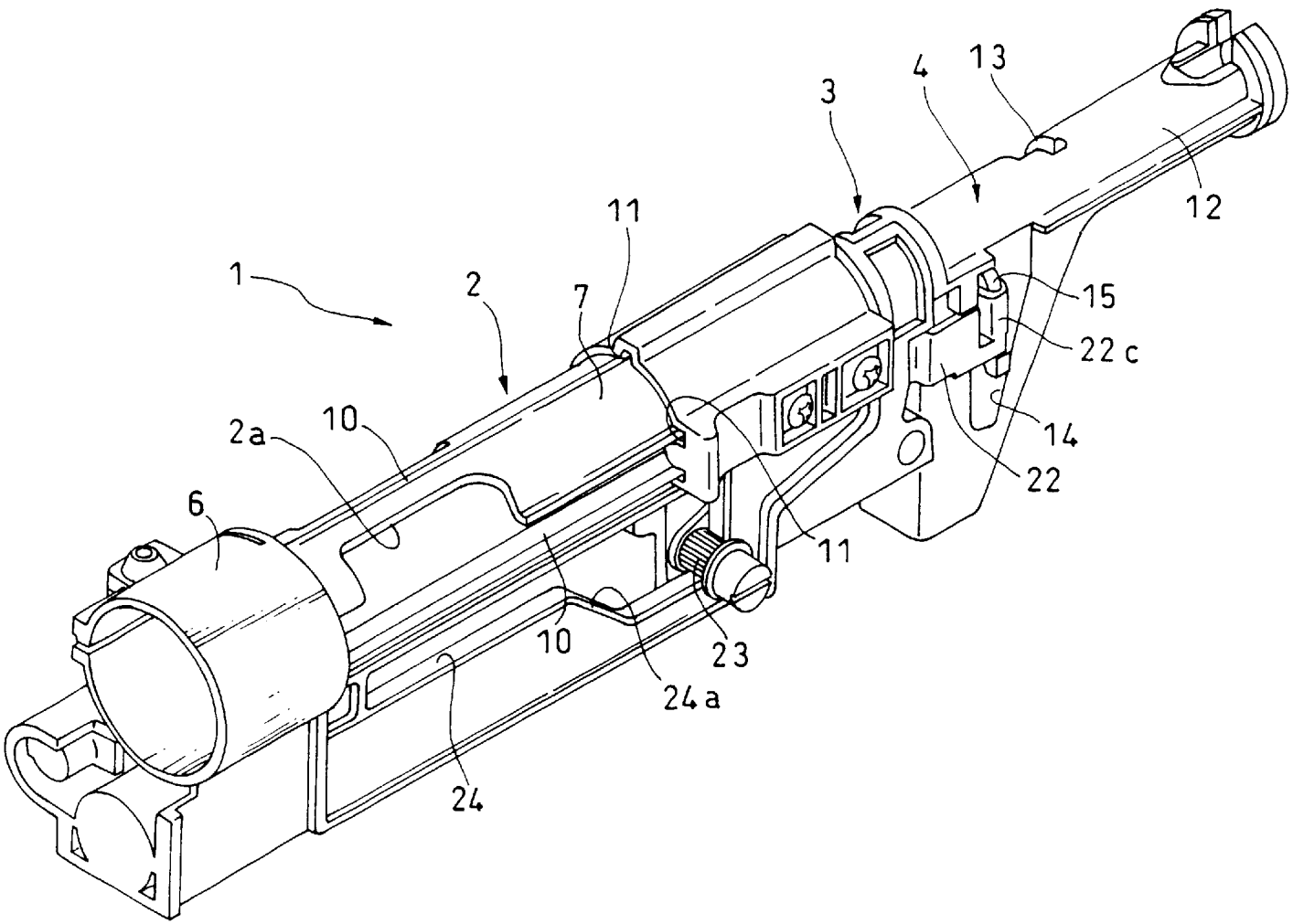
FIG. 1 is an overall oblique view illustrating an embodiment of the successive screw driving attachment pertaining to the present invention.
Figure 2:
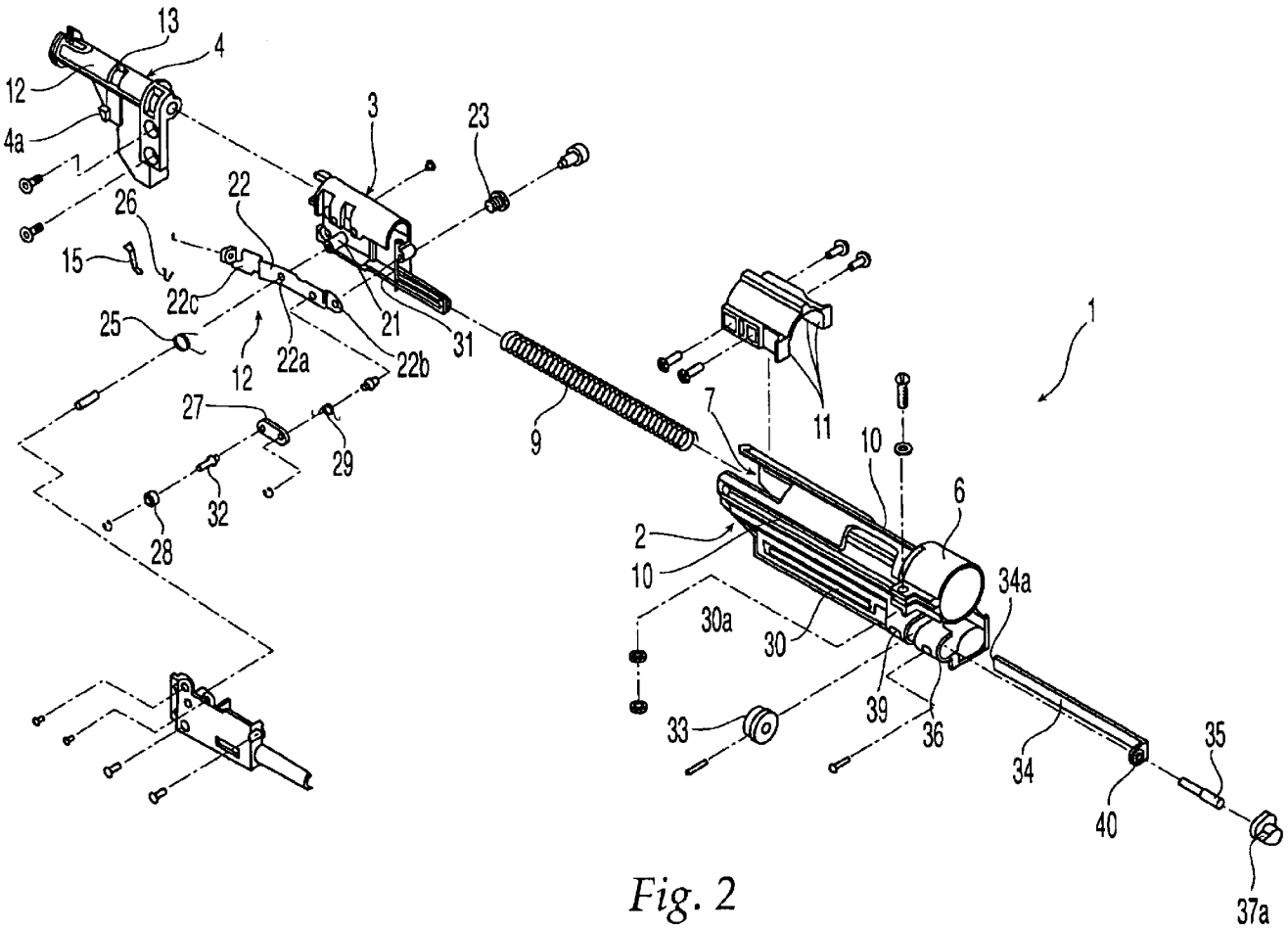
FIG. 2 is an exploded oblique view illustrating the overall successive screw driving attachment.
Figure 3:
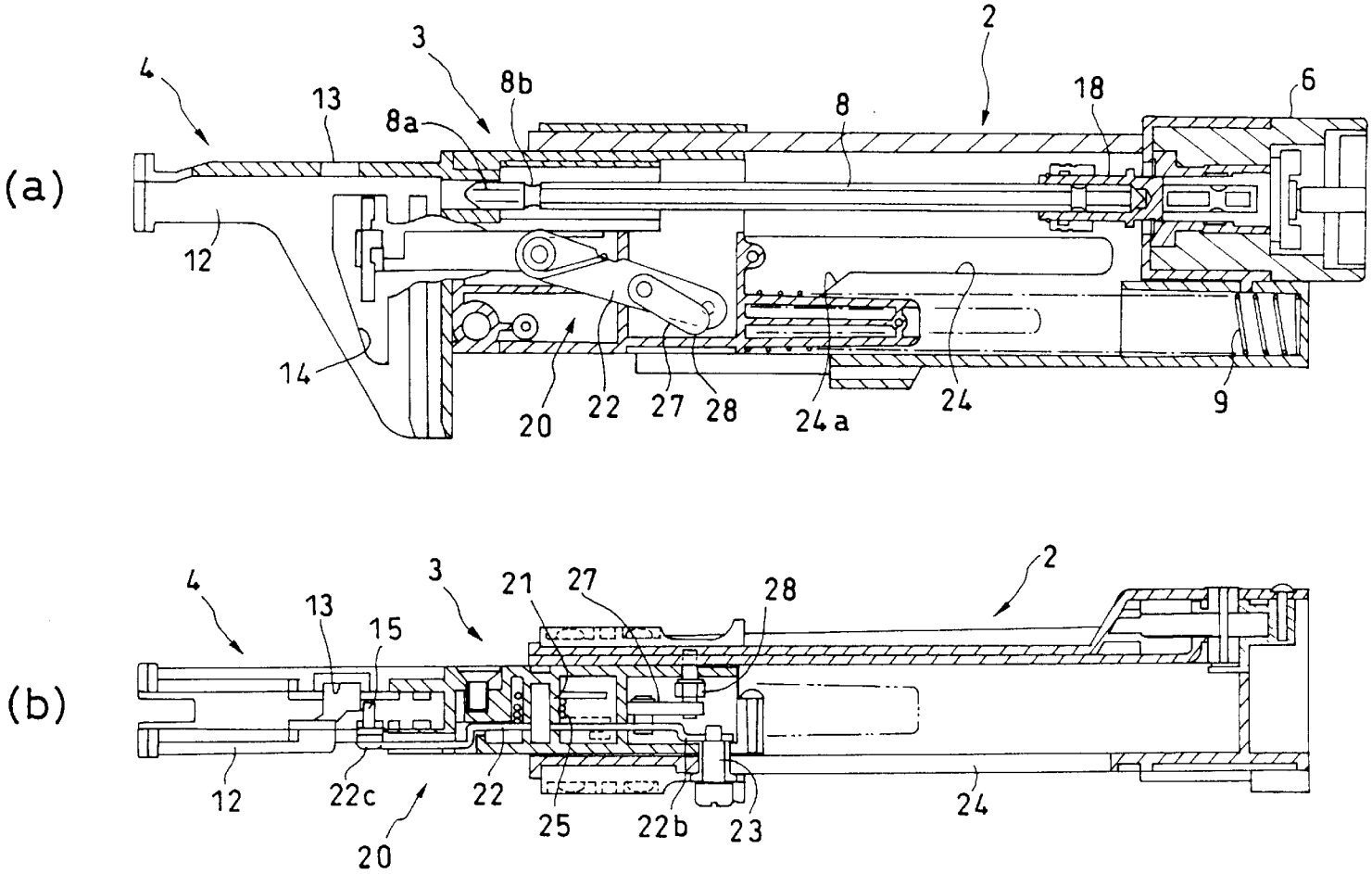
FIG. 3 is an overall view of the successive screw driving attachment, with (a) being a partially cut-away side cross section, and (b) a bottom cross section.

FIGS. 1 to 3 are overall views of the successive screw driving attachment pertaining to the present invention.

The successive screw driving attachment 1 pertaining to the present invention has a screw feed mechanism 3 and a distal end screw guide 4 provided to the front part of a driver unit 2, and has a coupling tube 6 for connecting to an electric screwdriver D via a coupling adapter 5 provided to the rear part of the driver unit 2.

The driver unit 2 consists of a guide tube 7 whose cross section is roughly elliptical (longer vertically). A single bit 8 for driving screws S is inserted on the upper side of this guide tube 7, while a coil spring or other such elastic member 9 for pressing the screw feed mechanism 3 forward is mounted on the lower side of the guide tube 7. This elastic member 9 serves to keep the screw feed mechanism 3 at the distal end position at all times through its elastic force. A guide slot 10 is formed around the guide tube 7. This screw feed mechanism 3 is attached slidably in the longitudinal direction in this guide slot 10 with an engagement component 11 interposed on the screw feed mechanism 3 side. The coupling tube 6, which is used to connect with the electric screwdriver D that rotationally drives the bit 8, is provided to the rear portion of the guide tube 7.

The bit 8, as shown in FIG. 3(*a*), is a member corresponding to a standard screwdriver tool, and its cross sectional shape is hexagonal. At both ends of this bit 8 are formed an engagement protrusion 8*a* that engages with an engagement groove in the head of the screw S, such as a plus-shaped groove, and a groove 8*b* that is fixed in the socket 18 of the coupling adapter 5 (discussed below), which is formed around the periphery [of the bit 8] in the vicinity of this engagement protrusion 8*a*. This bit 8 can be turned around longitudinally for use at both ends according to the wear of the engagement protrusions 8*a*. If both of the engagement protrusions 8*a* become worn, then the bit 8 is replaced with a new one. This replacement of the bit 8 is accomplished by inserting a finger through a manipulation window 2*a* made in the vicinity of the coupling tube 6 of the driver unit 2, releasing the socket 18, and removing the bit 8.

Figure 4:
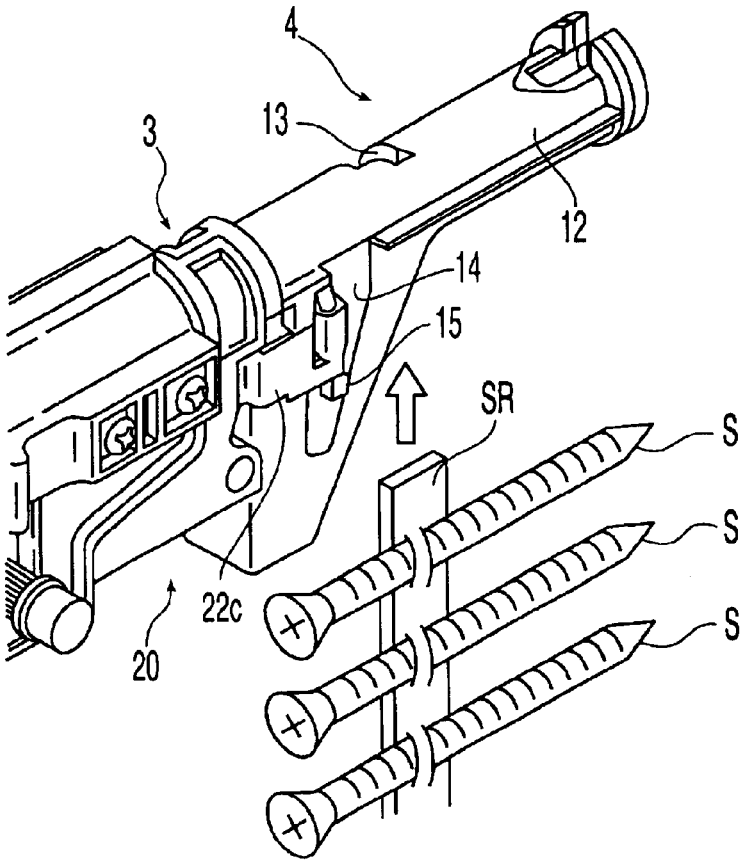
FIG. 4 is an oblique view illustrating a state in which the screw rope is being loaded into the distal end screw guide.

FIG. 4 shows a state in which the screw rope is being loaded into the distal end screw guide.

The distal end portion of this distal end screw guide 4 comes into contact with the material into which the screw S is to be driven, and is used to guide the screw S in the direction in which it is to be driven. The distal end screw guide 4 comprises a screw guide tube 12 (see FIG. 3(*b*)) that is open on its lower side. The open portion on the lower side of this screw guide tube 12 is the portion where the screw rope SR is supplied. The distal end screw guide 4 is also provided with a rope guide path 13, which faces the feed direction of the screw rope SR so as to intersect with the screw guide tube 12. Since a screw feed prong 15 moves back and forth inside a screw feed hole 14 in the side surface of the distal end screw guide 4, if this screw feed prong 15 is pressed after a screw has been driven, then the screw rope SR can be easily removed from the distal end screw guide 4.

Figure 5:
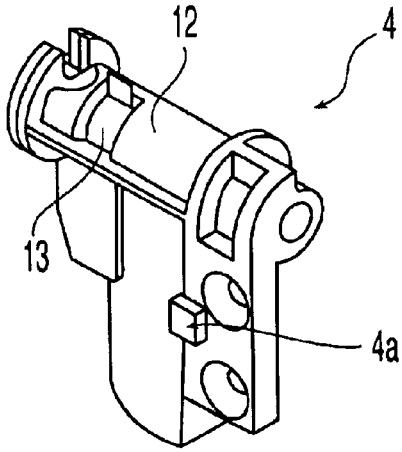
FIG. 5 is an oblique view of another embodiment of the distal end screw guide.

FIG. 5 illustrates another embodiment of the distal end screw guide.

The distal end screw guide 4 can be structured such that screw guide tubes 12 of different lengths are used interchangeably according to the length of the screws being used. The distal end screw guide 4 can be replaced by means of a stop screw at the front end of the screw feed mechanism 3. For example, when long screws S are used, a distal end screw guide 4 equipped with a long screw guide tube 12 is installed in the screw feed mechanism 3 (see FIG. 4). Conversely, when short screws S are used, a distal end screw guide 4 equipped with a short screw guide tube 12 is installed in the screw feed mechanism 3. Using various distal end screw guides 4 like this allows the screws S always to be driven in a stable state.

Figure 6:
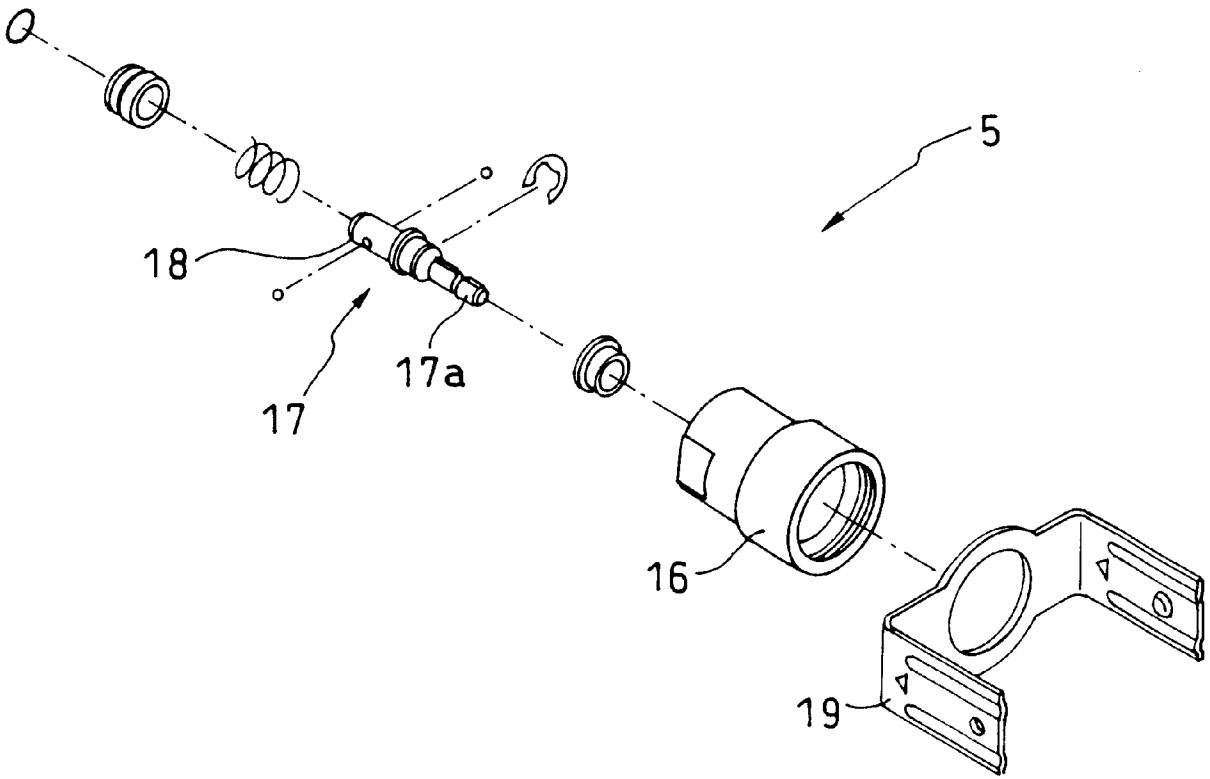
FIG. 6 is an exploded oblique view of the coupling adapter.

FIG. 6 illustrates the coupling adapter.

The coupling adapter 5 connected to the coupling tube 6 has a rotary main shaft 17 rotatably mounted in a through hole made in the direction of the rotational axis of a coupling tube 16 that is approximately cylindrical in shape. The rear end 17*a* of this rotary main shaft 17 is the portion that connects to the chuck of the electric screwdriver D. The distal end portion of this rotary main shaft 17 is equipped with a socket 18 capable of detachably coupling with the bit 8. A bracket 19 that connects to an arm 52 (discussed below) toward the rear of the successive screw driving attachment 1 is attached to the rear portion of this coupling adapter 5.

Figure 7:
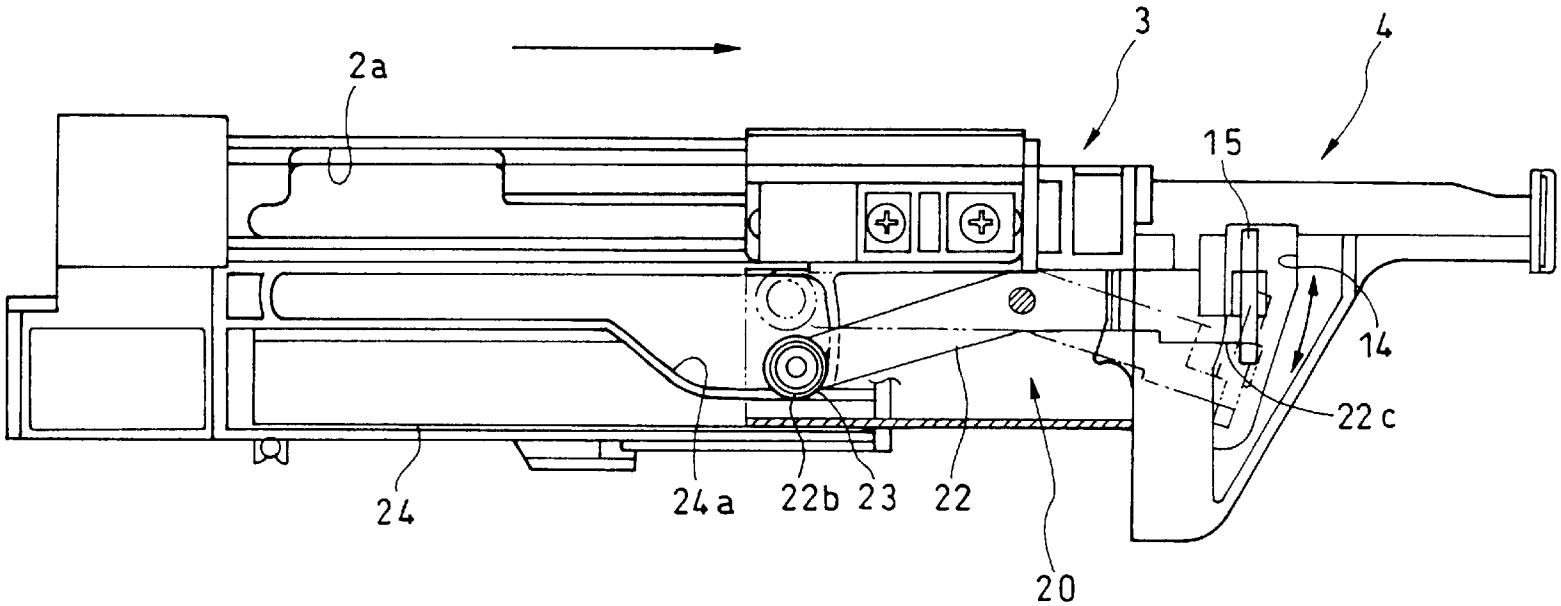
FIG. 7 is a partially cut-away side view illustrating the operating state of the screw feed mechanism and screw feeder.

FIG. 7 illustrates the operating state of the screw feed mechanism and screw feeder.

The screw feed mechanism 3 is provided with a screw feeder 20 that successively feeds the various screws S of the screw rope SR to the driving position in interlock with the driving action in the screw feed mechanism 3. This screw feeder 20 is a mechanism for feeding the individual screws S of the screw rope SR inserted into the rope guide path 13 of the distal end screw guide 4 to the driving position in interlock with the driving action of the bit 8.

The screw feeder 20 is attached swingably around a fulcrum 22*a* of an approximately caret-shaped feed lever 22 to a boss 21 of the screw feed mechanism 3 (see FIG. 2). The driven portion 22*b* of this feed lever 22 has a laterally projecting control roller 23 that moves inside a cam housing 24 having a sloped surface 24*a* formed on the sides of the driver unit 2. This cam housing 24 is formed such that it can function as a cam that allows the control roller 23 of the driven portion 22*b* of the feed lever 22 to move reciprocally. An elastic member 25 that constantly biases a free portion 22*c* of the feed lever 22 in the direction of the driving position is provided to this feed lever 22 (see FIG. 2).

The free portion 22*c* of the feed lever 22 is provided such that the screw feed prong 15 projects from the screw feed hole 14. This screw feed prong 15 is attached rotatably in the feed direction of the screw rope SR on a shaft, and a force that biases the screw feed prong 15 in the feed direction of the screw rope SR is provided by an elastic member 26 in the vicinity of the attachment position of this screw feed prong 15.

As shown by the solid line portion in FIG. 7, when the feed lever 22 retracts along with the screw feed mechanism 3 at the same time a screw S is driven, the control roller 23 of the driven portion 22*b* strikes the sloped surface 24*a* of the cam housing 24 and gradually rotates upward. At this point the screw feed prong 15 (the free portion 22*c*) moves toward the position of the next screw 5, that is, toward the lower side of the screw feed mechanism 3, as shown by the imaginary line portion in FIG. 7. The screw feed prong 15 strikes the next screw S in line upon returning to its standby position when a screw S is fed, but because this screw feed prong 15 falls while pivoting on a shaft, it does not hinder the feed of the screw rope SR in any way. With the next screw S thus grasped by the screw feed prong 15 (the standby state of feeding the screw rope), the screw feed mechanism 3 is pushed back by the elastic member 9 within the guide tube 7 of the driver unit 2. This achieves a standby state for driving the first screw S.

Figure 8:
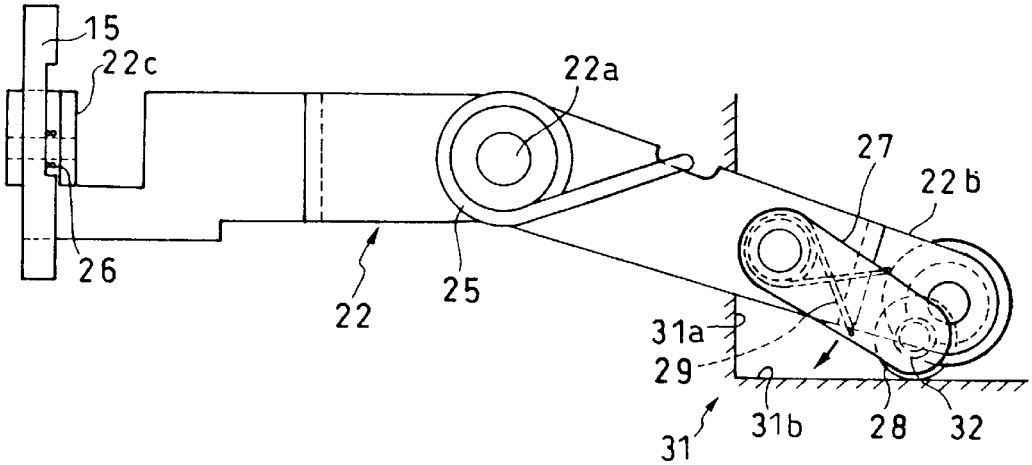
FIG. 8 is diagrams illustrating the operating state of the stopper provided to the feed lever, with (a) being a state in which the stopper is tilted and the screw is instantly fed, and (b) a state in which the stopper is actuated and the screw feed prong is on standby.
Figure 8:
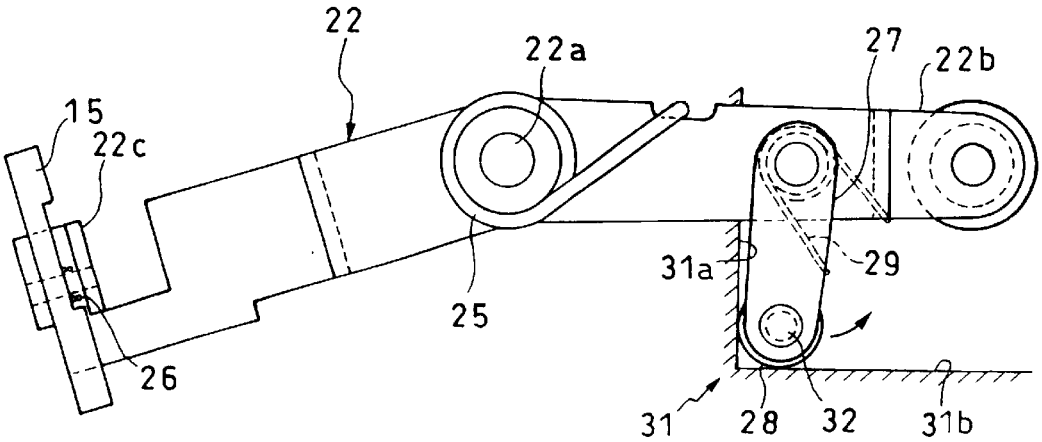

FIGS. 8(*a*) and (*b*) illustrate the operating state of the stopper provided to the feed lever.

The feed lever 22 is provided with a stopper 27 that keeps the screw S in a feed standby state within the screw feed mechanism 3. This stopper 27 has a rod-shaped member equipped with a roller and is rotatably attached in the vicinity of the driven portion 22*b*. The stopper 27 is biased downward in the figure from the driven portion 22*b* by the force of a limiting spring 29. However, the elastic force of this limiting spring 29 is weaker than that of the elastic member 25 of the feed lever 22. The stopper 27 is also designed such that it can be varied between a tilted state and an upright state while the roller 28 at the distal end rotates within guide walls 31 consisting of a vertical wall 31*a* and a horizontal wall 31*b* formed inside the screw feeder 20. Thus, as shown in FIG. 8(*a*), when this stopper 27 is tilted, the elastic force of the elastic member 25 of the feed lever 22 causes the driven portion 22*b* of the feed lever 22 to be in a tilted state. The screw feed prong 15 of the free portion 22*c* is in the driving position at this point.

As shown in FIG. 8(*b*), this feed lever 22 is such that the control roller 23 of the driven portion 22*b* first hits the sloped surface 24*a* of the cam housing 24, allowing the driven portion 22*b* of the feed lever 22 to be kept horizontal. The screw feed prong 15 at this point can move to its standby position when the screw S is fed (see FIG. 9(*c*)). At the same time, the stopper 27 is rotated into its upright state by the action of the limiting spring 29. When the stopper 27 is thus upright, the stopper 27 prevents the return of the feed lever 22, allowing the free portion 22*c* (screw feed prong 15) of the feed lever 22 to be kept in a standby state for feeding the screw rope SR. However, the feed lever 22 is such that when the screw feed mechanism 3 has returned to the distal end, a shaft 32 of the roller 28 of the stopper 27 hits a distal end surface 30*a* of a stopper limiting groove 30, the stopper 27 returns to a tilted state as shown in FIG. 8(*a*), the function of the stopper 27 is released, and the feed lever 22 instantly returns due to the elastic force of the elastic member 25.

With the screw feed mechanism 3 structured in this way when the bit 8 drives the screw S, the screw feed prong 15 can be kept in the standby state it is in prior to the feed of the screw S even if the screw feed mechanism 3 is in the process of being pushed back in the distal end direction upon completion of the driving of a single screw S. The next screw S will therefore not be fed to the driving position until the screw feed mechanism 3 has been completely pushed back in the distal end direction. Then, once the screw feed mechanism 3 has been completely returned to the distal end position, the stopper 27 of the feed lever 22 is released, and the next screw S can be instantly fed to the driving position by the elastic force of the elastic member 25.

Figure 9:
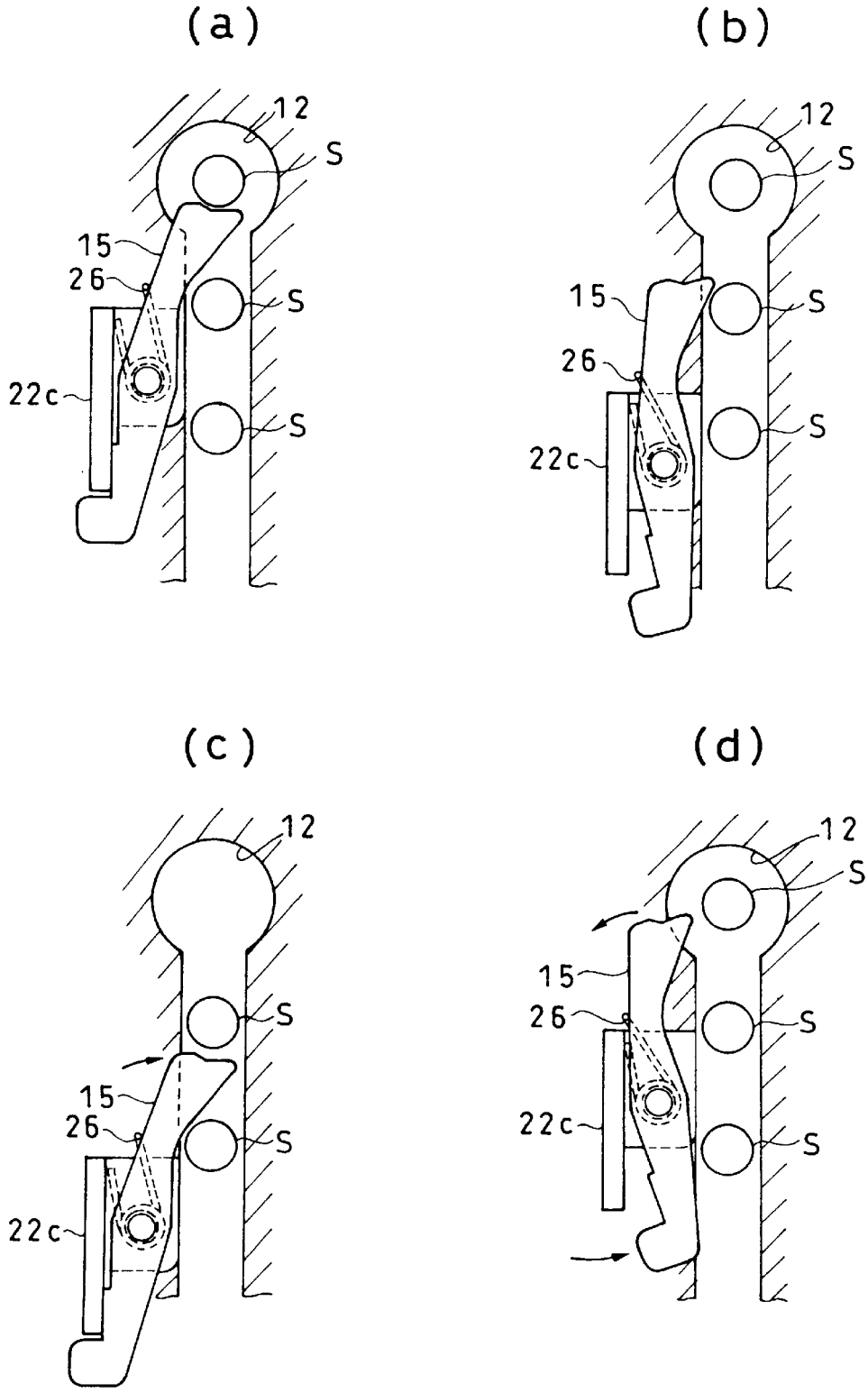
FIG. 9 is an enlarged front view illustrating the operating state of the screw feed prong, with (a) being immediately after the loading of the screw, (b) a state in which the next screw is fed, (c) a standby state for feeding the screw, and (d) a state in which the screw is extracted.

FIGS. 9(*a*) to (*d*) illustrate the operating state of the screw feed prong.

The screw feed prong 15 is such that a member formed in the shape of a rod having a socket is attached rotatably to the free portion 22*c* of the feed lever 22 so that it is approximately parallel to the feed direction of the screw rope SR and its distal end projects to the driving position. Since the swing direction of the screw feed prong 15 is therefore close to being parallel with the feed direction of the screw rope SR, and the swing angle is narrow, if the screw rope SR is inserted into the rope guide path 13 of the distal end screw guide 4 during screw driving work, this screw feed prong 15 will separate from the screw S a little as shown in FIG. 9(*d*), but will quickly tilt as shown in FIG. 9(*a*), completing the loading of the screw rope SR. In moving to the standby position it is in when the screw S is fed, the screw feed prong 15 separates from the screw S by pivoting on the shaft while striking the next screw 5, as shown in FIG. 9(*b*). After this, the screw feed prong 15 swings as shown in FIG. 9(*c*), and is maintained by the action of the stopper 27 in the standby state it is in when the screw rope SR is fed.

Upon completion of the driving work, the screw rope SR can be easily removed from the distal end screw guide 4 by pushing on part of this screw feed prong 15 from the outside.

The driving depth of the above-mentioned bit 8 is adjusted by rotation of an adjuster ring 33 that is provided to the guide tube 7 of the driver unit 2 and serves as the drive depth adjustment mechanism. This adjuster ring 33 is threadably fastened to an adjustment rod 34 projecting toward the distal end screw guide 4 inside the guide tube 7 of the driver unit 2. The rotary adjustment with this adjuster ring 33 varies the distance the end 34*a* of the adjustment rod 34 moves toward the distal end screw guide 4, to limit movement of the guide 4 relative to the guide tube 7 so that when the projection 4*a* on the side of guide 4 engages the end 34*a* of the adjustment rod 34 the driving depth of the screw S will be varied. If this adjuster ring 33 is turned to the right, for instance, the screw is driven a short distance, and if turned to the left, the screw is driven more deeply. As the projection of the adjuster rod 34 lengthens, the return distance of the screw feed mechanism 3 and the distal end screw guide 4 shortens and the driving distance of the bit 8 is shortened relatively. Conversely, as the projection of the adjuster rod 34 shortens, the return distance of the screw feed mechanism 3, and the distal end screw guide 4 lengthens and the driving distance of the bit 8 is lengthened relatively. The end of the projection 40 of the adjustment rod 34 is through the opening 39 in the housing 36 to show the amount of movement of the adjustment rod 34.

Next, the method for operating the successive screw driving attachment pertaining to the present invention will be described through reference to FIGS. 10(*a*) and (*b*).

Figure 10A:
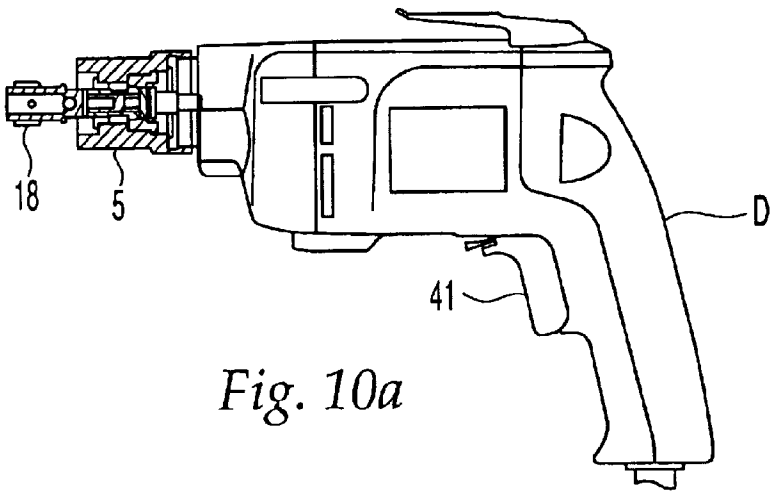
FIG. 10 illustrates a state in which an electric screwdriver is connected to the successive screw driving attachment, with (a) being a side view illustrating a state in which the coupling adapter has been mounted on the electric screwdriver, and (b) a plan view illustrating a state in which the successive screw driving attachment has been coupled to the coupling adapter.
Figure 10B:
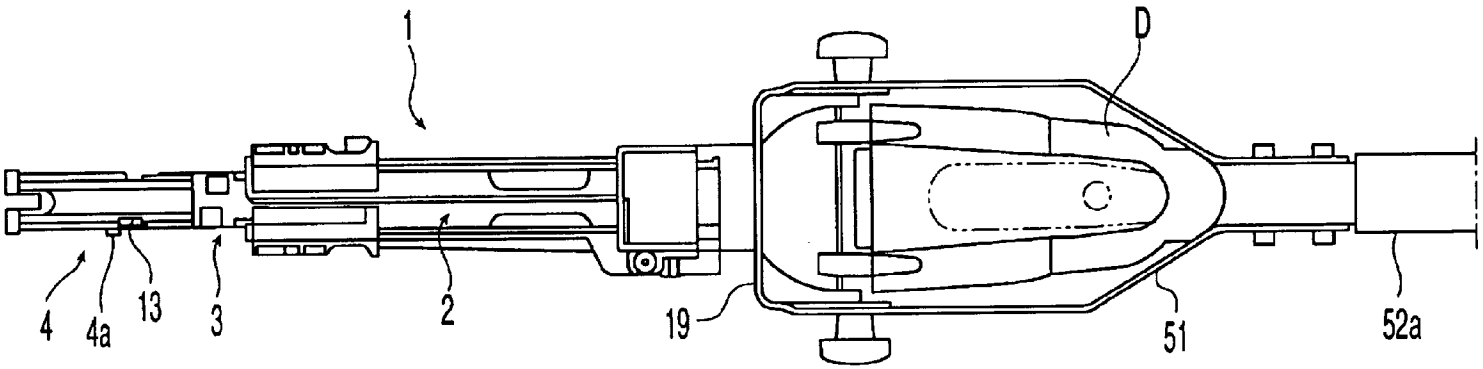

In the use of the driving attachment 1, the coupling tube 16 of the coupling adapter 5 is threaded onto electric screwdriver D, as shown in FIG. 10(*a*). Then, as shown in FIG. 10(*b*), the coupling tube 6 of the successive screw driving attachment 1 is connected to coupling adapter 5. Finally, the bit 8 is coupled to the socket 18 of the rotary main shaft 17 of this coupling adapter 5. In this state, the motor rotates when a trigger switch 41 of the electric screwdriver D is pulled. The bit 8, however, will not rotate in this state.

Next, the distal end of the screw rope SR is inserted from the open side of the screw guide tube 12 of the distal end screw guide 4, and the first screw S is loaded at the driving position (the screw guide tube 12 position). Thus, [the screw S] is placed in the position where it will be driven by the bit 8, and the motor is rotated by pressing on the trigger switch 41 of the electric screwdriver D. The distal end screw guide 4 is then pressed against the sheeting or other material.

When the successive screw driving attachment 1 is pressed against the sheeting while the motor is rotating, the clutch engages, the bit 8 turns, and the screw S is gradually driven into the sheeting or other material. Simultaneously with this driving of the screw 5, the screw feed mechanism 3 gradually retracts inside the driver unit 2, and the driving of the screw S is completed. If the distal end of the adjustment rod 34 that serves as the drive depth adjustment mechanism should collide with the distal end screw guide 4 at this time, the clutch wilt be disengaged from the bit 8, and the rotation of the bit 8 will stop.

Then, after this driving of the screw S is complete, the successive screw driving attachment 1 is pulled away from the sheeting or other material, whereupon the biasing force of the elastic member 9 causes the screw feed mechanism 3 to be pushed back to its original distal end position inside the driver unit 2, at which time the screw feeder 20 is actuated, and the screw feed prong 15 of the feed lever 22 instantaneously feeds the next screw S on the screw rope SR to the driving position, allowing screw driving work to be performed by the same operation as above. After moving to this driving position, the screw S is on standby in this position until it is driven.

Figure 11:
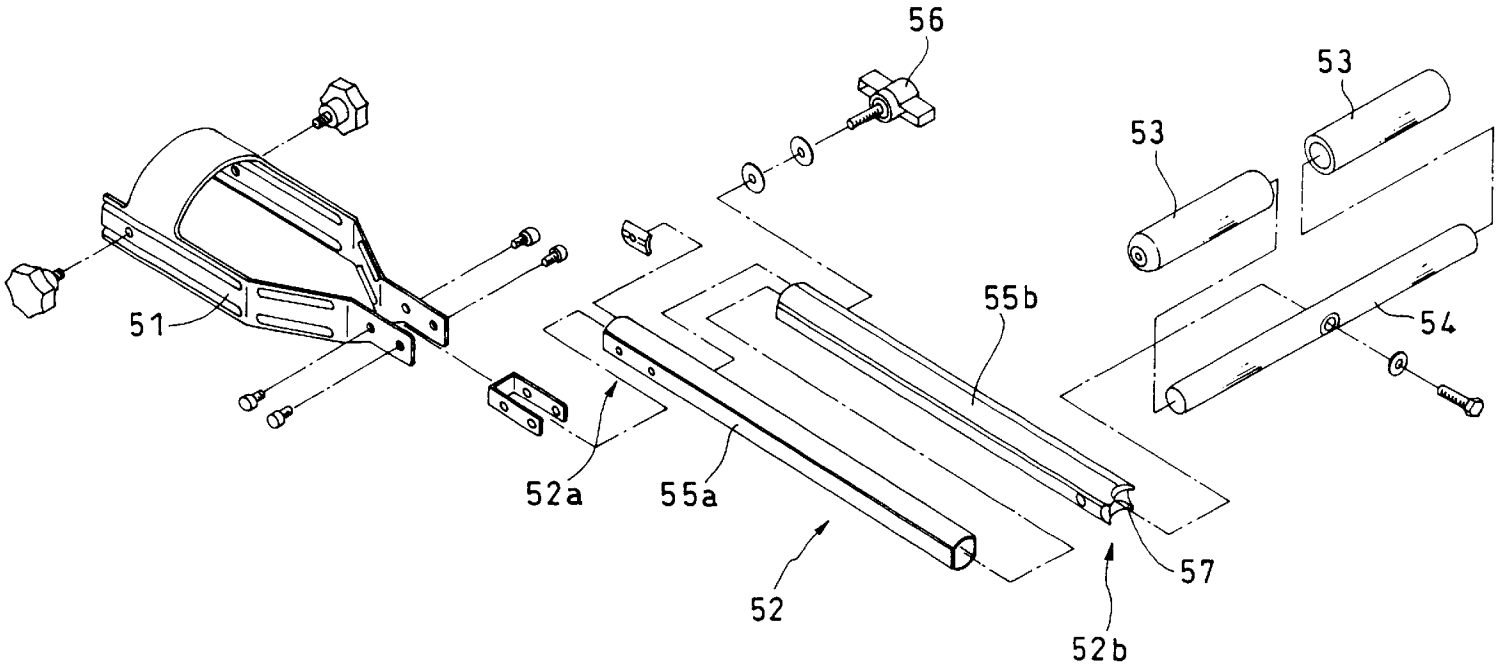
FIG. 11 is an exploded oblique view arm having a grip that is detachably attached the successive screw driving attachment.
Figure 12:
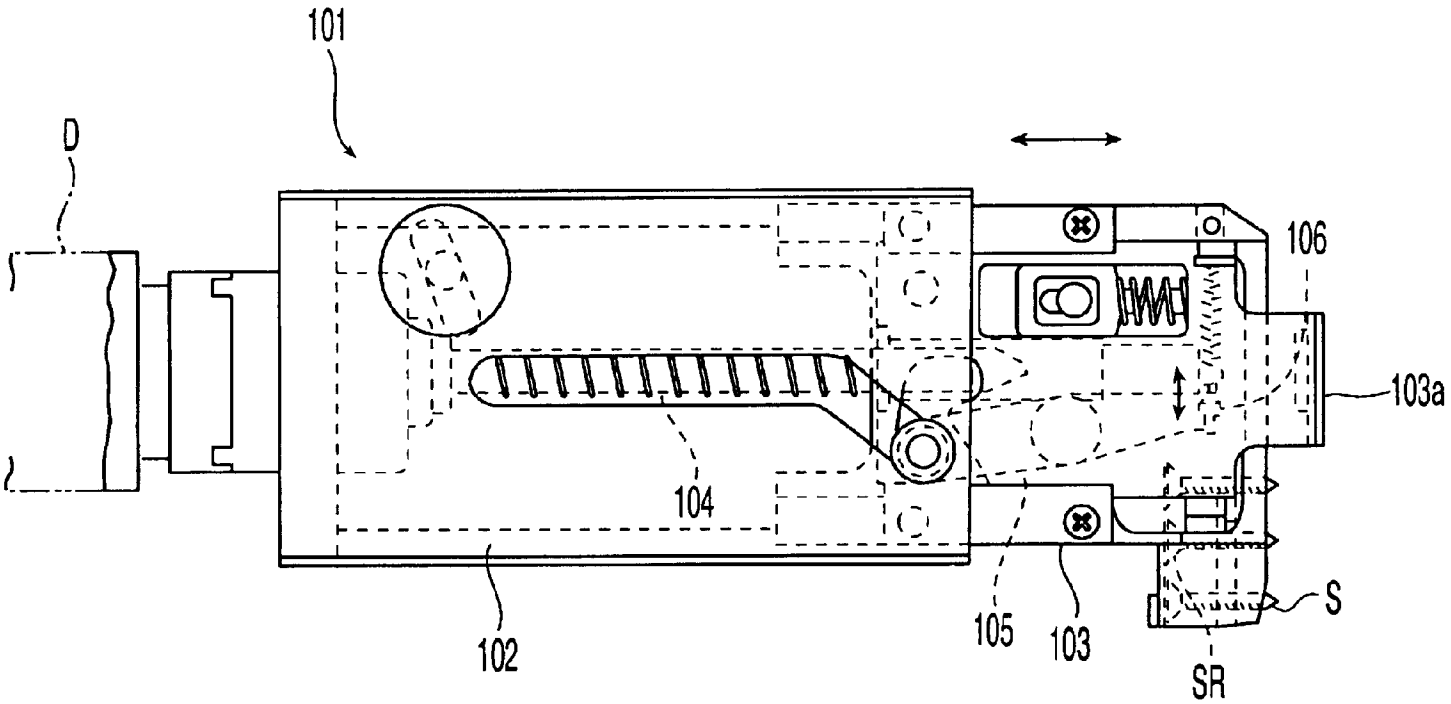
Fig. 12 PRIOR ART
FIG. 12 is a plan view illustrating successive screw driving attachment.

FIG. 11 shows the arm having a grip that is detachably attached to the successive screw driving attachment pertaining to the present invention.

An arm bracket 51 is detachably attached to the bracket 19 attached toward the rear of the coupling adapter 5, and the distal end 52*a* of the arm 52 is fixed to this arm bracket 51. To this arm 52 is detachably attached a pipe 54 portion that supports two approximately T-shaped grips 53 composed of a plastic foam. This arm 52 comprises two pipes 55*a* and 55*b* of different diameter, allowing the overall length thereof to be adjusted. The length of these two pipes 55*a* and 55*b* can be adjusted with a knob 56. Approximately hemispherical notches 57 are formed at the rear end 52*b* of this arm 52, and the attachment position of the pipe 54 of the grips 53 can be varied in orientation by 90 degrees with respect to the axial direction of the arm 52 in these notches 57.

When the successive screw driving attachment 1 with the arm 52 thus attached is used on a floor, the worker can carry out the work by grasping the grips 53 portion while standing. Even if the trigger switch 41 of the electric screwdriver D is moved to the "on" position, the screw feed mechanism 3 will not hinder the screw driving work because the bit 8 will not turn unless this screw feed mechanism 3 is made to slide while the motor of the electric screwdriver D is rotating.

The use of the successive screw driving attachment 1 pertaining to the present invention is not limited to a dedicated electric screwdriver D as discussed above. If the construction of the coupling adapter 5 is changed, this attachment can, of course, be coupled to many different types of electric screwdriver D.

Merits of the Invention

Because the successive screw driving attachment pertaining to the present invention is structured as above, the screw rope SR can be smoothly loaded to the driving position by delaying the timing at which the screws are fed to the driving position with a stopper provided to the feed lever of the screw rope. Meanwhile, the screw rope SR can be removed with just a finger. In particular, when the screw feed mechanism has completely returned to its distal end position, the next screw can be instantly fed to the driving position, so the feed of screws during driving work is more reliable.

Also, even with screws of greatly different length, the screws can always be fed to the screw feed mechanism and driving work carried out in a stable state by fixing a long-screw distal end screw guide to the screw feed mechanism, or exchanging and fixing a short-screw distal end screw guide to the screw feed mechanism as needed, so a single successive screw driving attachment can do the work of several.

Furthermore, since an arm having a grip can be attached via a bracket to the coupling adapter at the rear of the successive screw driving attachment, a worker can drive screws from a standing position. Similarly, he can drive screws into a ceiling without having to stand on a ladder, among other such advantages, so the effect of implementing the present invention is tremendous.

What is claimed is:

1. A successive screw driving attachment in which a screw feed mechanism and a distal end screw guide are provided to a front part of a driver unit, and a coupling tube for connecting to an electric screwdriver via a coupling adapter is provided to a rear part of said driver unit, wherein said driver unit forms a guide tube into which a bit is inserted, an elastic member is mounted for pressing the screw feed mechanism forward so that it is slidable in a longitudinal direction of said guide tube, and a drive depth adjustment mechanism that adjusts a depth to which the screw is driven by said bit;

said screw feed mechanism includes a screw feeder comprising a screw feed prong that sequentially feeds the screws on a screw rope, in which numerous screws are lined up and attached to a rope, to a driving position of said bit for interlock with the longitudinal sliding of said driver unit that accompanies the driving action produced by said bit in said distal end screw guide;

said screw feeder is structured such that said screw feed prong instantly feeds the next screw to the driving position when said screw feed mechanism has been pushed back to the distal end; said distal end screw guide has a rope guide path for said screw rope, and has formed in it a screw feed hole for the reciprocal action of said screw feed prong; and wherein a bracket is attached to said coupling adapter and an arm having a grip is detachably attached to said bracket.

2. A successive screw driving attachment in which a screw feed mechanism and a distal end screw guide are provided to a front part of a driver unit, and a coupling tube for connecting to an electric screwdriver via a coupling adapter is provided to a rear part of said driver unit, wherein said driver unit forms a guide tube into which a bit is inserted, an elastic member is mounted for pressing the screw feed mechanism forward so that it is slidable in a longitudinal direction of said guide tube, and a drive depth adjustment mechanism that adjusts a depth to which the screw is driven by said bit;

said screw feed mechanism includes a screw feeder comprising a screw feed prong that sequentially feeds the screws on a screw rope, in which numerous screws are lined up and attached to a rope, to a driving position of said bit for interlock with the longitudinal sliding of said driver unit that accompanies the driving action produced by said bit in said distal end screw guide;

said screw feeder is structured such that said screw feed prong instantly feeds the next screw to the driving position when said screw feed mechanism has been pushed back to the distal end;

said distal end screw guide has a rope guide path for said screw rope, and has formed in it a screw feed hole for the reciprocal action of said screw feed prong;

wherein said screw feed mechanism has a feed lever rotatably attached on a fulcrum, the driven portion of said feed lever is engaged with a cam housing formed in said driver unit, and the screw feed prong on the free portion of said feed lever is reciprocally operated;

a stopper for keeping the screw rope in a feed standby state is pivoted on said feed lever, and said stopper is released when said screw feed mechanism has been pushed back to the distal end in the screw driving operation, allowing said screw feed lever to be operated instantaneously; and wherein a bracket is attached to said coupling adapter, and an arm having a grip is detachably attached to said bracket.

3. A successive screw driving attachment in which a screw feed mechanism and a distal end screw guide are provided to a front part of a driver unit, and a coupling tube for connecting to an electric screwdriver via a coupling adapter is provided to a rear part of said driver unit, wherein said driver unit forms a guide tube into which a bit is inserted, an elastic member is mounted for pressing the screw feed mechanism forward so that it is slidable in a longitudinal direction of said guide tube, and a drive depth adjustment mechanism that adjusts a depth to which the screw is driven by said bit;

said screw feed mechanism includes a screw feeder comprising a screw feed prong that sequentially feeds the screws on a screw rope, in which numerous screws are lined up and attached to a rope, to a driving position of said bit for interlock with the longitudinal sliding of said driver unit that accompanies the driving action produced by said bit in said distal end screw guide;

said screw feeder is structured such that said screw feed prong instantly feeds the next screw to the driving position when said screw feed mechanism has been pushed back to the distal end;

said distal end screw guide has a rope guide path for said screw rope, and has formed in it a screw feed hole for, the reciprocal action of said screw feed prong;

wherein said screw feed mechanism has a feed lever rotatably attached on a fulcrum, the driven portion of said feed lever is engaged with a cam housing formed in said driver unit, and the screw feed prong on the free portion of said feed lever is reciprocally operated;

a stopper for keeping the screw rope in a feed standby state is pivoted on said feed lever, and said stopper is released when said screw feed mechanism has been pushed back to the distal end in the screw driving operation, allowing said screw feed lever to be operated instantaneously;

wherein said screw feed prong is a member formed in the shape of a rod, and is rotatably attached to the free portion of said feed lever so as to be roughly parallel to the feed direction of said screw rope and so that the distal end side thereof projects to the driving position; and wherein a bracket is attached to said coupling adapter, and an arm having a grip is detachably attached to said bracket.

4. A successive screw driving attachment in which a screw feed mechanism and a distal end screw guide are provided to a front part of a driver unit, and a coupling tube for connecting to an electric screwdriver via a coupling adapter is provided to a rear part of said driver unit, wherein said driver unit forms a guide tube into which a bit is inserted, an elastic member is mounted for pressing the screw feed mechanism forward so that it is slidable in a longitudinal direction of said guide tube, and a drive depth adjustment mechanism that adjusts a depth to which the screw is driven by said bit;

said screw feed mechanism includes a screw feeder comprising a screw feed prong that sequentially feeds the screws on a screw rope, in which numerous screws are lined up and attached to a rope, to a driving position of said bit for interlock with the longitudinal sliding of said driver unit that accompanies the driving action produced by said bit in said distal end screw guide;

said screw feeder is structured such that said screw feed prong instantly feeds the next screw to the driving position when said screw feed mechanism has been pushed back to the distal end;

said distal end screw guide has a rope guide path for said screw rope, and has formed in it a screw feed hole for the reciprocal action of said screw feed prong;

wherein the distal end screw guide can be detachably attached to said screw feed mechanism; and wherein a bracket is attached to said coupling adapter, and an arm having a grip is detachably attached to said bracket.

* * * * *